US010464782B2

(12) United States Patent
Steinhauer et al.

(10) Patent No.: US 10,464,782 B2
(45) Date of Patent: Nov. 5, 2019

(54) LIFT SYSTEM HAVING A PLURALITY OF CARS AND A DECENTRALISED SAFETY SYSTEM

(71) Applicants: ThyssenKrupp Elevator AG, Essen (DE); ThyssenKrupp AG, Essen (DE)

(72) Inventors: Eduard Steinhauer, Nürtingen (DE); Matthias Glück, Hochdorf (DE); Bankole Adjibadji, Nürtingen (DE)

(73) Assignee: thyssenkrupp AG, Essen (DE)

( * ) Notice: Subject to any disclaimer, the term of this patent is extended or adjusted under 35 U.S.C. 154(b) by 392 days.

(21) Appl. No.: 15/529,999

(22) PCT Filed: Nov. 10, 2015

(86) PCT No.: PCT/EP2015/076140
§ 371 (c)(1),
(2) Date: May 26, 2017

(87) PCT Pub. No.: WO2016/083114
PCT Pub. Date: Jun. 2, 2016

(65) Prior Publication Data

US 2017/0327345 A1 Nov. 16, 2017

(30) Foreign Application Priority Data

Nov. 27, 2014 (DE) ..... 10 2014 017 486

(51) Int. Cl.
*B66B 5/00* (2006.01)
*B66B 9/00* (2006.01)
(Continued)

(52) U.S. Cl.
CPC ..... *B66B 5/0031* (2013.01); *B66B 1/3415* (2013.01); *B66B 1/3492* (2013.01);
(Continued)

(58) Field of Classification Search
CPC ... B66B 5/0031; B66B 1/3415; B66B 1/3492; B66B 5/02; B66B 9/003; B66B 11/0407
(Continued)

(56) References Cited

U.S. PATENT DOCUMENTS 3,896,736 A 7/1975 Hamy
5,877,462 A * 3/1999 Chenais ..... B66B 5/0031 187/249
(Continued)

FOREIGN PATENT DOCUMENTS

CN 101687606 A 3/2010
CN 102264622 A 11/2011
(Continued)

OTHER PUBLICATIONS

International Search Report for International Application No. PCT/EP2015/076140 dated Feb. 16, 2016, 3 pages.
(Continued)

*Primary Examiner* — David S Warren
(74) *Attorney, Agent, or Firm* — RMCK Law Group PLC

(57) ABSTRACT

The disclosure relates to an elevator system consisting of a plurality of elevator carriages, a shaft system, a drive system for separately moving the elevator carriages within the shaft system, as well as a safety system having a plurality of safety nodes designed to bring the elevator system into a safe operating mode if an operating mode of the elevator system, which deviates from the normal operation mode, is detected. The elevator carriages, the shaft system and the drive system form a functional unit. One of the safety nodes is always assigned to one of the functional units, wherein the safety nodes are each connected to at least another safety node through an interface for transmitting data. Each safety node includes at least one sensor, which detects an operating parameter of the corresponding assigned functional unit. A
(Continued)

control unit evaluates the operating parameter detected by one of the sensors of the respective safety node and, taking into account the data transmitted by at least another safety node.

11 Claims, 5 Drawing Sheets

(51) Int. Cl.
*B66B 11/04* (2006.01)
*B66B 1/34* (2006.01)
*B66B 5/02* (2006.01)

(52) U.S. Cl.
CPC ..... *B66B 5/02* (2013.01); *B66B 9/003* (2013.01); *B66B 11/0407* (2013.01)

(58) Field of Classification Search
USPC ..... 187/393
See application file for complete search history.

(56) References Cited

U.S. PATENT DOCUMENTS

| | | | | |
|---|---|---|---|---|
| 8,230,977 | B2 * | 7/2012 | Thumm | B66B 1/34 187/247 |
| 8,739,936 | B2 * | 6/2014 | Kostka | B66B 1/2433 187/249 |
| 8,813,919 | B2 * | 8/2014 | Silberhorn | B66B 5/0031 187/249 |
| 8,827,043 | B2 * | 9/2014 | Kostka | B66B 1/2433 187/249 |
| 9,010,499 | B2 * | 4/2015 | McCarthy | B66B 5/0031 187/393 |
| 9,096,410 | B2 * | 8/2015 | Iwata | B66B 5/024 |
| 9,371,210 | B2 * | 6/2016 | Parillo | B66B 5/0018 |
| 9,708,158 | B2 * | 7/2017 | Kakio | B66B 5/0031 |
| 9,758,347 | B2 * | 9/2017 | Dudde | B66B 9/00 |
| 10,035,684 | B2 * | 7/2018 | Roberts | B66B 1/2491 |
| 10,118,800 | B2 * | 11/2018 | Siikonen | B66B 5/027 |
| 2009/0277724 | A1 * | 11/2009 | Thumm | B66B 1/34 187/393 |
| 2011/0259674 | A1 | 10/2011 | Silberhorn et al. | |
| 2011/0302466 | A1 | 12/2011 | Ikawa et al. | |
| 2013/0192932 | A1 * | 8/2013 | Parillo | B66B 5/0018 187/289 |
| 2017/0233221 | A1 * | 8/2017 | Geisshusler | B66B 5/0031 187/247 |
| 2017/0327345 | A1 * | 11/2017 | Steinhauer | B66B 11/0407 |
| 2017/0334678 | A1 * | 11/2017 | Sonnenmoser | B66B 1/3438 |
| 2017/0355553 | A1 * | 12/2017 | Steinhauer | B66B 5/0031 |
| 2018/0334363 | A1 * | 11/2018 | Saarela | B66B 13/02 |
| 2019/0119068 | A1 * | 4/2019 | Sonnenmoser | B66B 5/0018 |
| 2019/0140860 | A1 * | 5/2019 | Sonnenmoser | B66B 1/3453 |
| 2019/0210838 | A1 * | 7/2019 | Studer | B66B 5/0031 |

FOREIGN PATENT DOCUMENTS

| | | | |
|---|---|---|---|
| CN | 203143855 | U | 8/2013 |
| CN | 203450982 | U | 2/2014 |
| EP | 0769469 | A1 | 4/1997 |
| EP | 1562848 | A1 | 8/2005 |
| EP | 2022742 | A1 | 2/2009 |
| EP | 1719727 | B1 | 4/2013 |
| WO | 2010072714 | A1 | 7/2010 |
| WO | 2012038760 | A2 | 3/2012 |

OTHER PUBLICATIONS

Chinese Office Action for Chinese Application No. 201580064099.4 dated Aug. 23, 2018, 8 pages.
Korean Office Action for KR Application No. 10-2017-7017448 dated Oct. 30, 2018, 4 pages.

* cited by examiner

LIFT SYSTEM HAVING A PLURALITY OF CARS AND A DECENTRALISED SAFETY SYSTEM

FIELD

The invention relates to an elevator system comprising a plurality of elevator carriages, a shaft system that allows a loop operation of the elevator carriages, at least one drive system to move the elevator carriages within the shaft system as well as a safety system with a plurality of safety nodes. The safety system of the elevator system is designed to bring the elevator system into a safe operating mode if an operating mode of the elevator system, which deviates from a normal operating mode, is detected. The elevator carriages of the elevator system, the shaft system of the elevator system and the at least one drive system of the elevator system in each case form at least one functional unit.

BACKGROUND

On account of the fact that in such an elevator system several elevator carriages can be moved largely independent of one another in a common shaft of the shaft system, the problem with such elevator systems is to ensure that a collision between the adjacent elevator carriages is reliably avoided.

To this end, it is normally necessary for a plurality of operating parameters of an elevator system to be recorded and analyzed, in particular the current position of each elevator carriage. The more elevator carriages an elevator system has, the more complex becomes the amount of data that has to be processed and transmitted.

An elevator system with at least one shaft in which at least two elevator carriages can be moved along a common transportation route is known from the document EP 1 562 848 B1. In this elevator system, the elevator carriages are each assigned a control unit, a drive unit and a brake. In order to prevent a collision between the elevator carriages of the elevator system, the distance between adjacent elevator carriages is respectively monitored. If a specified critical minimum distance is fallen short of, it is envisaged that an emergency stop of the elevator carriage be triggered.

A further elevator system in which a plurality of elevator carriages can be moved simultaneously in at least one shaft is known from document EP 0 769 469 B1. In this elevator system, each elevator carriage has its own drive unit and its own safety module. The safety modules are hereby designed to trigger the brake system of the respective elevator carriage as well as of other elevator carriages. To this end, it is envisaged that data recorded and/or analyzed by one safety module be transmitted to all other safety modules. One problem known from EP 0 769 469 B1 is that the amount of data to be transmitted is so large that a constant transmission and analysis of this data by the safety modules is not possible, at least not with a reasonable technical effort, which is why EP 0 769 469 B1 suggests working with a dynamic elevator model.

SUMMARY

With this in mind, one task of the present invention is to improve an elevator system of the kind mentioned at the beginning. In particular, an elevator system with an improved safety system is to be provided. The elevator system should preferably enable a safety concept that uses a distributed system architecture and advantageously enables short response times. The communication load that is incurred to ensure the safe operation of an elevator system should preferably be reduced compared to previously known elevator systems.

In order to solve the problem, an elevator system is suggested comprising a plurality of elevator carriages, a shaft system allowing a loop operation of the elevator carriages, at least one drive system to move the elevator carriages and a safety system with a plurality of safety nodes, which is designed to bring the elevator system into a safe operating mode if an operating mode of the elevator system, which deviates from a normal operating mode, is detected. The elevator carriages, the shaft system and the at least one drive system each form at least one functional unit. At least one of the safety nodes is hereby assigned to each functional unit. Each functional unit thus advantageously has at least one safety node. The safety nodes are connected to at least one of the other safety nodes via at least one interface to transmit data. In addition, each of the safety nodes comprises at least one sensor to record an operating parameter of the correspondingly assigned functional unit. Furthermore, each of the safety nodes comprises at least one control unit that is designed to analyze the operating parameter recorded by the at least one sensor of the respective safety node and, taking into account, in other words taking particular account of the data transmitted from at least one further safety node, to take a decision with respect to an operating mode which deviates from a normal operating mode. Data transmitted by a safety node are in particular operating parameters of that functional unit assigned to the safety node, preferably operating parameters that have already been analyzed.

The elevator system according to the invention therefore advantageously allows a decentral monitoring of the functional units of the elevator system. With respect to an operating parameter recorded by a functional unit, this does not advantageously first have to be transmitted to a central control unit but can be analyzed directly by the control unit of the safety node assigned to the functional unit. This advantageously reduces the amount of data to be transmitted and thus the communication load.

Since the elevator system according to the invention also advantageously allows the detection of an operating mode which deviates from a normal operating mode at each safety node, in particular if a functional unit does not work as planned, for example if an elevator carriage cannot be moved or is moved at an excessively high speed, short response times are advantageously enabled. hereby the safety of an elevator system is advantageously further improved.

In accordance with an advantageous embodiment of the elevator system according to the invention, it is envisaged that the at least one drive system can be operated section-wise in the shaft, advantageously in such a way that the elevator carriages can be moved independent of each other in defined sections of the shaft system, whereby each of the defined sections is preferably a functional unit of the drive system, each of which is assigned at least one of the safety nodes. The drive system preferably comprises at least one linear motor. The elevator system preferably has rails as part of the linear drive, along which the elevator carriages can be moved separately. The rails are hereby advantageously energized section-wise, so that the drive system is designed so that it can be operated section-wise in the shaft. Thanks to the rails that can be energized section-wise, the elevator carriages of the elevator system can advantageously be moved independent of each other. In this case in particular, such a section of rail that can be energized is a defined section of the shaft system, which as such in each case forms a functional unit of the drive system. The drive system as a functional unit thus itself advantageously has a plurality of functional units, each of which is advantageously assigned a safety node.

It is in particular envisaged that such a section of rail of the linear drive that can be energized in each case forms a functional unit. Advantageously, each section of rail that can be energized or groups of sections of rail that can be energized is assigned a safety node as a functional unit. Sensors in this safety node advantageously check the section of rail for relevant operating parameters, in particular whether a section of rail is working properly and/or whether an elevator carriage in the elevator system is being moved along a section of rail.

The control unit of such a safety node is hereby advantageously designed, depending on the current positions of the elevator carriages of the elevator system, to deactivate different linear motor segments, in particular the aforementioned sections of rail of the linear drive, in particular to eliminate possible sources of error and if necessary to bring the elevator system and/or the corresponding functional unit of the drive system into a safe operating mode.

In particular, a further advantageous embodiment is envisaged in which the control unit of a safety node assigned to a functional unit of the drive system can affect the control of the linear motor segments. It is hereby in particular envisaged that an elevator carriage moving along a linear motor segment can be braked if the safety node assigned to this elevator carriage signals a collision risk to the safety node assigned to this linear motor segment. In order to enable such a data exchange, the safety nodes are advantageously connected to each other via a communication interface, for example via a communication bus or an air interface, in particular using WLAN (WLAN: Wireless Local Area Network).

A further particularly advantageous embodiment of the elevator system according to the invention envisages that the shaft system of the elevator system comprises at least two vertically extended transportation routes along which the elevator carriages can be moved vertically, and at least two transfer units to displace the elevator carriages between the transportation routes. Each of the transfer units is hereby advantageously a functional unit of the shaft system, each of which is assigned a safety node. By means of the transfer units, the elevator carriages can advantageously be moved, in particular between shafts in the shaft system of the elevator system. Each shaft can hereby represent a transportation route. However, a shaft in accordance with an embodiment variant can also comprise several transportation routes, preferably in such a way that several elevator carriages can be moved simultaneously adjacent to each other and in succession in the shaft.

The transfer unit in particular envisages a means for the loop operation of the elevator carriages in the elevator system. This kind of loop operation in particular envisages that the elevator carriages are moved along at least one transportation route of the shaft system exclusively in one direction, for example upwards, and along at least one further transportation route of the shaft system exclusively in a different direction, for example downwards.

Because it is planned in accordance with a preferred embodiment of the invention for the individual transfer units or a group of transfer units to be each assigned a safety node, the correct function of the transfer units is advantageously monitored directly at the transfer units. This advantageously further reduces the amount of data to be transmitted. If there is a fault in a transfer unit so that this can no longer be operated in a normal operating mode but is brought into a safe operating mode, this is advantageously communicated to other safety nodes that are assigned to further functional units. The elevator system is hereby advantageously designed in such a way that the elevator system can continue to be operated, whereby the elevator carriages no longer stop at the faulty or non-operational transfer unit.

In a specially preferred embodiment of the elevator system according to the invention it is envisaged that the transportation routes of the shaft system are rails, along which the elevator carriages can be moved by means of at least one linear drive as a drive system. Each rail is hereby advantageously designed with at least one segment that can be rotated to the vertical transportation route as a transfer unit, whereby these rotatable segments can be arranged relative to one another, such that an elevator carriage of the elevator system can be moved along the segments between the rails.

In accordance with a further, particularly advantageous embodiment of the elevator system according to the invention, the functional units of the elevator system each have at least one safety device. This at least one safety device can advantageously bring the respective functional unit into a safe operating mode if triggered. Furthermore, it is advantageously envisaged that the at least one safety device can be triggered directly by the control unit of the safety node assigned to the corresponding functional unit. A brake or safety gear is hereby envisaged in particular as a safety device for an elevator carriage. A switch unit, for example a contactor circuit, that can switch off the functional unit, is envisaged in particular as a safety device for a functional unit of the drive system. A locking mechanism that can fix the transfer unit in a defined position is envisaged in particular as a safety device for a transfer unit as a functional unit of the shaft system.

The safety nodes are advantageously arranged on the functional units, preferably in such a way that the control unit, the at least one sensor and the at least one safety device are arranged together on a functional unit. As a result, decisions to bring a functional unit and thus an elevator system into a safe operating mode can advantageously be taken locally and decentrally. This advantageously leads to an increased robustness of the safety system. Moreover, safety-relevant decisions can advantageously be taken simultaneously. For example, an elevator carriage can be brought to a stop by triggering the brake and at the same time the corresponding functional unit of the drive system that was responsible for moving this elevator carriage can be deactivated. Moreover, a high scalability of the system can be achieved with the suggested elevator system. Modifications to the safety system, for example at a larger number of elevator carriages, can hereby advantageously be carried out with relatively little effort.

A further, particularly advantageous embodiment of the elevator system according to the invention provides for the definition of a plurality of monitoring rooms for the shaft system of the elevator system, whereby each monitoring room is assigned a plurality of functional units, whereby the safety nodes of the functional units in the monitoring rooms are connected by at least one interface to transmit data. The monitoring rooms are not structural or constructional separate areas but rather room segments defined relative to the safety system, which in particular may overlap too. Through the definition of these monitoring rooms, the elevator system is advantageously split up into subsystems regarding the monitoring of a normal operating mode, whereby each subsystem is advantageously monitored with respect to an operating mode that deviates from a normal operating mode. A monitoring room is hereby advantageously assigned at least one elevator carriage, at least one functional unit of the shaft system and at least one functional unit of the drive system. Particularly preferred are also monitoring rooms that are assigned to elevator carriages adjacent to one elevator carriage, in particular a preceding elevator carriage and a following elevator carriage. Each elevator carriage is hereby advantageously assigned at least two monitoring rooms, namely once as an elevator carriage that is surrounded by two adjacent elevator carriages and once as an elevator carriage adjacent to an elevator carriage.

An advantageous embodiment of the invention provides that the monitoring rooms have fixed spatial assignments, preferably via spatial coordinates that represent positions within the shaft system of the elevator system. The shaft system can hereby be represented in particular by a permanently assigned grid. One grid that is in principle suitable for this purpose is known, for example, from document EP 1 719 727 B1.

As a further advantageous embodiment, it is planned to define a certain area containing an elevator carriage as a monitoring room so that this monitoring room is moved with the elevator carriage, as it were. If a further elevator carriage is moved in this monitoring room, this is advantageously monitored too with respect to any deviation from, a normal operating mode. In particular it is envisaged that the monitoring room is always assigned at least one functional unit of the shaft system and at least one functional unit of the drive system in this embodiment, whereby the assigned functional unit can change when the elevator carriage is moved.

In particular, each area of the shaft in the shaft system to which one of the elevator carriages can be moved is assigned at least one monitoring room.

Advantageously, only operating parameters are exchanged between safety nodes within the respective monitoring room that are necessary to determine an operating mode of the elevator system that deviates from a normal operating mode. Only when an operating mode that deviates from a normal operating mode is detected is this information advantageously transmitted beyond the monitoring room to other safety nodes too.

In accordance with a further advantageous embodiment of the invention, the elevator system is designed so that it can be partially deactivated, in particular in such a way that individual functional units of groups of functional units, in particular individual elevator carriages and/or functional units of the drive system can be deactivated, whereby the elevator system is further developed so that it can continue to be operated with functional units that have not been deactivated.

Advantageously it is also envisaged that in each case, one section of the shaft system that has at least one shaft door is a functional unit, which is assigned at least one safety node. The safety node is hereby advantageously designed to monitor whether this functional unit is working correctly. To this end, the safety node advantageously has sensors to record operating parameters of this functional unit. Furthermore, it is in particular envisaged that the safety node of a control unit is designed to analyze the operating parameters and to analyze data received from the safety nodes of other functional units, for example operating parameters of an elevator carriage.

In accordance with a further advantageous aspect of the invention, the safety node assigned to the section of the shaft system with at least one shaft door as a functional unit has at least one sensor that is designed to record an operating mode of this functional unit that deviates from a normal operating mode. The elevator system is advantageously, preferably the safety system of the elevator system, in particular the safety nodes of the safety system assigned to this functional unit, is designed to deactivate this functional unit if it records an operating mode that deviates from a normal operating mode. The elevator system, preferably the safety system of the elevator system, is hereby advantageously further developed, to only move the elevator carriages of the elevator system outside this section of the shaft system that has at least one shaft door.

In particular, an opening of the shaft doors that deviates from a normal operating mode is to be provided as an operating mode that deviates from a normal operating mode. In order to monitor this, a sensor that monitors the opening and closing of the shaft doors is envisaged in particular. Since, for example, the movement of an elevator carriage in a shaft section with the shaft doors open is a potential risk to the user of the elevator carriage, this section is advantageously deactivated. The elevator system is hereby advantageously designed to no longer move the elevator carriages within this section of the shaft, but at most to only move the elevator carriages up to this section of the shaft.

In accordance with a further, particularly preferred embodiment of the elevator system according to the invention, the control unit of a safety node assigned to an elevator carriage as a functional unit is designed to continually calculate a first stop point for a first direction of travel of the elevator carriage and/or to continually calculate a second stop point for a second direction of travel of the elevator carriage. The corresponding stop point indicates the position at which the elevator carriage can stop, if necessary, in each direction of travel. The stop points are hereby calculated by analyzing operating parameters recorded by the sensors. The calculation is advantageously based on a predictor models performed by means of a calculator unit, in particular a calculator unit of the control unit. The sensor preferably analyzes those recorded operating parameters that belong to the same safety node. In addition, it is in particular envisaged that operating parameters transmitted to the safety nodes also be taken into account in the analysis. Those operating parameters taken into account in the analysis are in particular the speed of the elevator carriage, the position of the elevator carriage in the shaft system, the acceleration of the elevator carriage, the load capacity of the elevator carriage and the condition of the elevator carriage's brakes. These operating parameters and the stop points calculated from these are preferably determined in predefined discrete time intervals of 5 ms to 50 ms (ms: millisecond), for example This enables a quasi continual calculation of the stop points.

Advantageously, the safety node assigned to an elevator carriage is therefore designed to constantly, which essentially means continually, calculate the stop point for the first direction of travel and the stop point for the second direction of travel for this elevator carriage. This stop point in particular provides information on where this elevator carriage would stop or come to a standstill after braking, in particular emergency braking. Operating parameters for the other elevator carriages, in particular traveling parameters of the other elevator carriages, do not advantageously have to be taken into account when the stop points are determined in this way. As a result, the communication load is advantageously further reduced.

As a particularly advantageous further development of the elevator system it is envisaged that the safety node assigned to the elevator carriage as a functional unit is constructed such that the calculated initial stop points are always at least transmitted via an interface to the safety node that is assigned to the adjacent elevator carriage in the first direction of travel, and the calculated second stop points are always at least transmitted via an interface to the corresponding safety node that is assigned to the adjacent elevator carriage in the second direction of travel. In this way, the safety node assigned to an elevator carriage knows at any one time advantageously not only the stop points of this elevator carriage but also the stop points of the elevator carriages adjacent to this elevator carriage in the corresponding direction of travel.

In accordance with a further advantageous further development of the elevator system it is envisaged that the control unit of a safety node assigned to an elevator carriage as a functional unit is designed to determine the distance between the first stop point for this elevator carriage and the second stop point of the adjacent elevator carriage in the first direction of travel. Furthermore, this control unit is advantageously designed to determine the distance between the second stop point of this elevator carriage and the first stop point of the adjacent elevator carriage in the second direction of travel. The safety system of the elevator system is hereby advantageously designed to bring the elevator system into a safe operating mode if a negative distance is determined.

By comparing a stop point of an elevator carriage for one direction of travel with the stop point of an adjacent elevator carriage, the risk of a collision can advantageously and reliably be determined. In this embodiment, therefore, only stop points are advantageously transmitted and in particular no further operating parameters related to the elevator carriage, so that the amount of data to be transmitted is advantageously low. Since it is in particular envisaged that only the stop points of adjacent elevator carriages be compared with each other, the amount of data to be transmitted is advantageously further reduced.

A current stop point for one direction of travel of an elevator carriage is in particular the distance needed by the elevator carriage to come to a stop in this direction of travel starting from the current position of the elevator carriage. The distance is preferably extended by a safety distance, preferably a fixed safety distance, so that the stop point is correspondingly further away from the elevator carriage. Depending on the current operating parameters of an elevator carriage in the elevator system, the distance between the elevator carriage and stop point thus always changes for each direction of travel. In particular, the distance between the corresponding stop point and the elevator carriage increases with the speed at which the elevator carriage if moved.

The minimum distance, that two adjacent elevator carriages can have, hereby depends on several operating parameters, in particular the current position of the elevator carriages in the shaft system, the speed of the elevator carriages, the acceleration of the elevator carriages, the load capacities of the elevator carriages and/or the conditions of the brakes for the elevator carriages. These operating parameters are preferably only recorded individually for each elevator carriage to determine the corresponding stop point for the at least one direction of travel from these operating parameters for each elevator carriage. By comparing the stop points of adjacent elevator carriages it can advantageously be checked whether a minimum distance is observed between the elevator carriages, whereby this minimum distance is advantageously dynamically adjusted by the continual determination of the stop points and their comparison.

If a negative distance is determined when determining the distances between calculated stop points of adjacent elevator carriages, in other words, of the stop point of an elevator carriage is further away from this elevator carriage than the stop point of an adjacent elevator carriage, the elevator system is advantageously brought into a safe mode, in particular by braking the corresponding adjacent elevator carriages whose stop points display a negative distance and thus bringing them to a stop, in particular by triggering safety devices on these elevator carriages. It should be pointed out that the term "negative distance" refers to the case where the stop point of an adjacent elevator carriage is further away from this elevator carriage in question than the stop point of an adjacent elevator carriage, in particular a preceding or following elevator carriage. Whether the distance is in fact negative in the sense of a negative number hereby depends on the reference system used. Thus, a "negative distance" can also be expressed by a positive number with a corresponding reference system.

Advantageously, both horizontal and vertical movements of the elevator carriages can be taken into account and corresponding stop points calculated. A fast detection of possible collisions is advantageously provided.

In accordance with a particularly advantageous embodiment of the invention it is envisaged that the stop point of each elevator carriage is always calculated under the assumption of the latest stop of the corresponding elevator carriage when at least one of the safety devices of the elevator system takes effect. The calculation is advantageously a conservative one in this case. Even though the distance between adjacent elevator carriages is this sometimes larger than necessary, this reliably prevents any collision between adjacent elevator carriages. Safety devices on the elevator system are in this case in particular braking means, for example safety gear for the elevator carriages and/or braking means provided by the drive system. If the drive system for the elevator system comprises at least one linear drive, the section-wise deactivation of one line of the linear drive is to be provided in particular as an intervention by at least one safety device.

A further advantageous embodiment of the invention envisages calculating each of the stop points assuming a worst case scenario to reliably prevent a collision of adjacent elevator carriages in any case. In particular it is envisaged that the stop point of each elevator carriage is calculated under the additional assumption that the corresponding elevator carriage is accelerated with the maximum possible acceleration of the elevator system before at least one of the safety devices of the elevator system takes effect. For a stopping elevator carriage that can be moved up and down in a shaft, the stop point in the direction of travel "up" is advantageously calculated under the assumption that the elevator carriage initially accelerates to its maximum in the "up" direction of travel and is then brought to a stop by the intervention of at least one safety device. In the direction of travel "down", the stop point in the "down" direction of travel is advantageously calculated under the assumption that the elevator carriage initially accelerates to its maximum in the "down" direction of travel and is then brought to a stop by the intervention of at least one safety device. On account of the gravity acting on the elevator carriage, which are advantageously taken into account when calculating the stop points, the distance between the stop point in the "up" direction of travel and the upper end of the elevator carriages is hereby less than the distance between the stop point in the "down" direction of travel and the lower end of the elevator carriage.

In particular it is envisaged that an upper stop point and ad lower stop point be continually calculated for every elevator carriage in a vertical shaft of the shaft system of the elevator system in which at least three elevator carriages are moved. Apart from the elevator carriage that is at the highest point in the shaft and the elevator carriage that is at the lowest point in the shaft, all elevator carriages therefore have an upper adjacent elevator carriage and a lower adjacent elevator carriage. It is hereby advantageously envisaged that the distance between the upper stop point of an elevator carriage and the lower stop point of the upper adjacent elevator carriage always be determined. Furthermore, the distance between the lower stop point of an elevator carriage and the upper stop point of the lower adjacent elevator carriage is advantageously determined.

The stop points are advantageously defined by a grid that is permanently assigned to the shaft system. One grid that is in principle suitable for this purpose is known, for example, from document EP 1 719 727 B1.

In such a fixed grid, the lowest point that an elevator carriage can reach in the shaft system is preferably assigned the value 0. The highest point that an elevator carriage can reach in the shaft system is preferably assigned a corresponding maximum value. If the elevator carriages can also move laterally, the stop points can be represented in particular as coordinates (x, y) or (x, y, z). Only the corresponding coordinate is preferably taken into account for a current direction of travel, for example for the direction of travel x only the coordinate x. In particular in those areas where the direction of travel changes, for example from direction of travel x to direction of travel y, it is advantageously envisaged that more than one coordinate be taken into account for a corresponding section comprising the transitional area, thus with reference to the example shown above, the coordinates (x, y).

There is the risk of a collision when such a fixed grid is defined if the upper stop point of an elevator carriage is greater than the lower stop point of the elevator carriage moving above this elevator carriage. In this case, the elevator system is brought into a safe mode, in particular by bringing at least one of the two elevator carriages to a stop. The same applies accordingly if the lower stop point of an elevator carriage is smaller than the upper stop point of an elevator carriage moving below this elevator carriage.

Possible risks of collision between an elevator carriage and an upper adjacent elevator carriage and/or a lower adjacent elevator carriage are thus reliably detected, namely by checking whether a determined distance is negative, in other words the compared stop points have an overlapping area. If a negative distance is determined, the elevator system is advantageously brought into a safe mode from a normal operating mode, in particular by stopping the corresponding elevator carriages. The other elevator carriages continue to be operated advantageously in a restricted mode, whereby the stopped elevator carriages define a restricted area that the other elevator carriages still in operation may only approach up to a predefined distance The elevator carriages stopped when bringing the elevator system into a safe mode are preferably assigned fixed stop points so that a collision between elevator carriages and the stopped elevator carriages is prevented in particular by applying the same procedure.

Each control unit assigned to an elevator carriage advantageously calculates the stop points for the at least one direction of travel of this elevator carriage, in particular an upper and a lower stop point, exchanges these with the control units of the adjacent elevator carriages. Instead of calculating the distances between adjacent elevator carriages, the stop points are advantageously compared with each other, as already explained above. As long as the stop points do not overlap, in other words no negative distance is determined, there is no risk of a collision.

The control unit of an elevator carriage preferably triggers a safety device for this elevator carriage if a negative distance is determined between the stop points, whereby it is in particular envisaged that triggering the safety device brings the elevator carriage to a stop. The actuation of a brake on the elevator carriage is in particular envisaged as a safety device for the elevator carriage. The control device assigned to an elevator carriage is advantageously only responsible for the safety device of this elevator carriage with respect to the triggering of safety devices and advantageously does not have to brake other elevator carriages too. The advantageously further reduces the amount of data that has to be transmitted.

In particular it is envisaged that the stop points in each case be calculated from the current operating parameters of the corresponding elevator carriage. In accordance with a further advantageous embodiment variant, it is envisaged that stop points be predefined for all quantized combinations of operating parameters. An assignment of the stop points to such a combination of operating parameters hereby takes place in accordance with an advantageous embodiment via a lookup table. In particular, such an assignment is envisaged as a plausibility check of stop points calculated by real time calculations in accordance with a further advantageous embodiment variant. The elevator system advantageously is also brought into a safe mode if a predefined deviation between assigned stop points and calculated stop points is determined.

In particular, the elevator system according to the invention, and in particular the corresponding components of the elevator system, is designed to perform process steps described in connection with the invention.

BRIEF DESCRIPTION OF THE FIGURES

Further advantages, features and details of the embodiments of the invention will be explained in more depth in connection with the embodiments shown in the Figures. These show.

DETAILED DESCRIPTION

Figure 1:
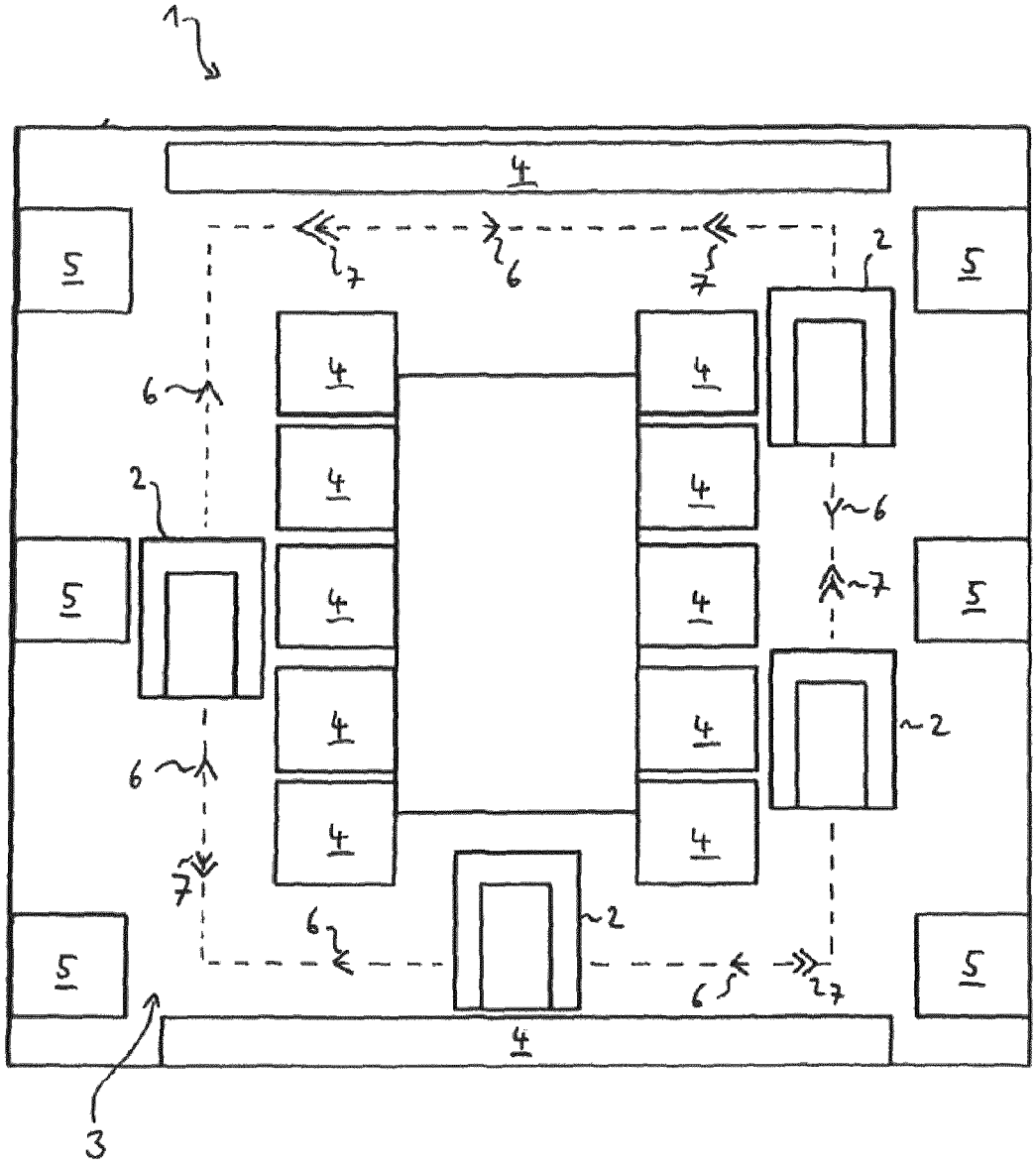
FIG. 1 An embodiment for an elevator system according to the invention in a simplified diagrammatic layout.

FIG. 1 shows a simplified elevator system 1 with a plurality of elevator carriages 2 and a shaft system 3. The elevator carriages 2 can be moved separately in a first direction of travel 6 (shown symbolically by a single arrow 6) and in a second direction of travel 7 (shown symbolically by a double arrow 7), in other words largely independent of each other. The elevator carriages 2 hereby form a functional unit of the elevator system 1 in each case. The shaft system 3 of the elevator system 1 is designed such that a loop operation of the elevator carriages 2 is possible. This means that the elevator carriages 2 in particular can be moved all in the first direction of travel 6 or all in the second direction of travel 7.

The elevator system 1 shown in FIG. 1 comprises a linear drive with a plurality of linear motor segments 4 to move the elevator carriages 2, whereby each of the linear motor segments 4 is a functional unit of the drive system for the elevator system 1. Through these linear motor segments 4, which can be activated and deactivated individually, the drive system of the elevator system 1 is advantageously designed to be operated section-wise in the shaft, in particular in such a way that the elevator carriages 2 can be moved independently in defined sections of the shaft system, whereby each of the linear motor segments 4 forms such a defined section and each is hereby a functional unit of the drive system.

The shaft system 3 of the elevator system 1 comprises a plurality of shaft doors 5, whereby the sections of the shaft system 3 comprising a shaft door 5 each forms a functional unit of the elevator system 1.

The elevator system 1 shown in FIG. 1 also comprises a safety system (not shown explicitly in FIG. 1) with a plurality of safety nodes (not shown explicitly in FIG. 1). At least one of the safety nodes is assigned one of the functional units, in other words and in particular an elevator carriage 2, at least one linear motor segment 4 and at least one section of the shaft comprising one shaft door 5. The safety nodes are hereby advantageously each connected to at least one of the other safety nodes via an interface to transmit data, for example a communication bus or wireless via an air interface. The safety nodes each comprise at least one sensor (not shown explicitly in FIG. 1) to record an operating parameter of the correspondingly assigned functional unit. For example it is envisaged that the position, speed, acceleration and load capacity of an elevator carriage be recorded as operating parameters.

Furthermore, it is envisaged that each of the safety nodes comprises at least one control unit (not shown explicitly in FIG. 1), which is designed to analyze the operating parameters recorded by the at least one sensor of the corresponding safety node. The control unit is advantageously further designed to take a decision with respect to an operating mode that deviates from a normal operating mode, taking into account this analysis and the data transmitted from the at least one further safety node.

The safety system of the elevator system 1 is thus advantageously designed to bring the elevator system into a safe operating mode if an operating mode of the elevator system 1, which deviates from a normal operating mode, is detected. A normal operating mode is hereby in particular error-free operation. A safe operating mode of the elevator system 1 is an operating mode into which the elevator system 1 is brought in the event of an error or danger. In particular, it is envisaged that in such a safe operating mode, at least one of the functional units of the elevator system 1 is deactivated. For example, at least one linear motor segment 4 can hereby be switched off and/or at least one elevator carriage 2 stopped by triggering an emergency braking and/or one section of the shaft system 3 comprising at least one shaft door 5 is not longer accessed by the elevator carriages 2.

Figure 2:
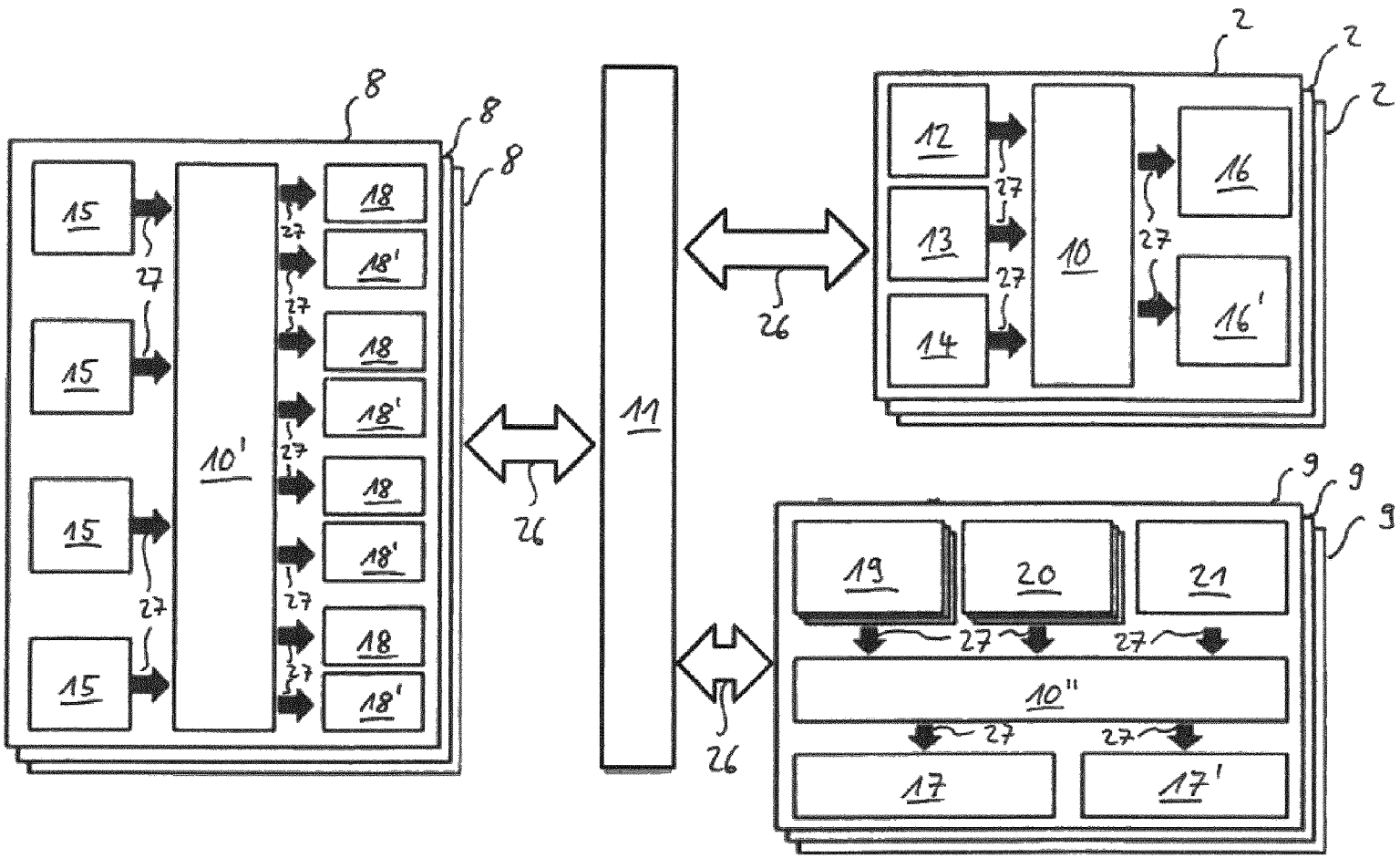
FIG. 2 an embodiment for an assignment of safety nodes to the functional units with an embodiment variant in an elevator system according to the invention in a simplified diagrammatic layout.

The safety system for an elevator system designed according to the invention will be explained in more detail with reference to FIG. 2. To this end, FIG. 2 shows diagrammatically a plurality of elevator carriages 2 as functional units of the elevator system, a plurality of sections of the shaft 8, each of which forms a functional unit of the shaft system, and a plurality of transfer units 9, which are designed to transfer elevator carriages 2 between different transportation routes, in particular different shafts of the shaft system, as further functional units of the shaft system.

The functional units 2, 8, 9 each have a safety node 10, 10', 10", whereby these safety nodes 10, 10', 10" are part of the safety system of the elevator system. The safety nodes 10, 10', 10" are hereby connected to each other via an interface 11 to transmit data (shown symbolically in FIG. 2 by arrows 26), whereby a safety protocol is preferably envisaged for the transmission 26.

The safety nodes 10, 10', 10" each comprises sensors to record operating parameters of the corresponding functional unit. The operating parameters recorded by the sensors 12, 13, 14, 15, 19, 20, 21 of a safety node 10, 10', 10" as well as data sent by other safety nodes to a safety node are hereby transmitted to a control unit (not shown explicitly in FIG. 2) of the safety node. The control unit, for example a correspondingly programmed micro controller circuit, hereby analyzes the data. In addition, the control unit is designed to trigger a safety device assigned to the corresponding functional unit 2, 8, 9 and this bring the elevator system into a safe operating mode. The transmission of data in a functional unit 2, 8, 9 is shown symbolically in FIG. 2 by the arrows 27. A data transmission can also be bidirectional, in other words opposite to the direction of the arrows 27.

The safety components, in particular the safety devices as well as the control units that trigger the safety devices, are advantageously positioned locally at the functional units 2, 8, 9, preferably directly on the actuators and sensors. This advantageously avoids real time communication over long distances.

Safety nodes are advantageously distributed in vertical and horizontal shafts of the shaft system of an elevator system. These hereby advantageously record the conditions of the shaft components. With reference to the functional unit shaft section 8, which is always assigned a safety node 10', the conditions of the shaft doors are recorded, for example, by sensors 15.

The safety nodes are advantageously designed to deactivate functional units of the elevator system via corresponding control units and safety devices, in particular to switch off drives. This can be done, for example, with reference to the functional unit shaft section 8, by triggering the safety devices 18, 18'. The safety devices 18 hereby provide a so-called "Safe Torque Off" (STO) functionality that switches the drives powerless. The safety devices 18' advantageously provide a functionality that also switches the drive off by a protective motor switch.

Safety nodes assigned to functional units of the shaft system are hereby preferably wired directly to the shaft components.

A transfer unit 9 in particular is provided for the horizontal transfer of an elevator carriage from one shaft to another shaft. This kind of transfer unit 9 is advantageously monitored by one of the safety nodes 10" assigned to the corresponding transfer unit 9. Position limit switch 19, devices to record the condition of a locking mechanism 20 and an absolute position sensor 21 hereby continually record operating parameters of the transfer unit 9 as sensors of the safety node in the embodiment. If an operating mode that deviates from a normal operating mode is determined by the safety node 10" of a control unit of the safety node 10", a safety device assigned to the transfer unit 9 is advantageously triggered, preferably a service brake 17 with a coupled drive shut-off 17', which can in particular be realized as a "Safe Torque Off" (STO) functionality.

The safety nodes 10 assigned to the elevator carriages 2 comprise in particular sensors 12, 13, 14 to record operating parameters with respect to the corresponding elevator carriage 2, in particular a sensor 12 to record the position of the elevator carriage, a sensor 13 to record the condition of the elevator carriage doors, in particular the conditions "closed"/"open"", a sensor 14 to record the load capacity of the elevator carriage 2. Further operating parameters are advantageously transmitted to the corresponding safety node 10 of an elevator carriage by further safety nodes. By analyzing the operating parameters, the safety node 10 hereby takes a decision with respect to an operating mode that deviates from a normal operating mode. If an operating mode that deviates from a normal operating mode is determined, the safety node 10 or the control unit for this safety node 10 advantageously triggers safety devices 16, 16' for the elevator carriage 2. This brings the elevator system into a safe operating mode. Safety devices for the elevator carriage are in particular a service brake 16 and redundant safety gear 16'.

In order to further reduce the processing load for each safety node, it is in particular envisaged to avoid or at least reduce a plurality of identical calculations and a plurality of identical decisions within the safety system of the elevator system. This is why the safety nodes 10, 10', 10" are advantageously designed to take decisions locally, in particular decisions with respect to the triggering of a safety device, and to transmit the corresponding results, conditions and/or decisions to the other safety nodes.

The safety nodes 10, 10', 10" of functional units 2, 8, 9 are hereby advantageously provided with at least the information and/or operating parameters listed below.

The safety node 10 of the elevator carriage 2 hereby advantageously has access to the following operating parameters

- X, Y, Z position, speed and acceleration of the elevator carriage;
- Load capacity of the elevator carriage;
- condition of the elevator carriage door;
- condition of the actuator system and/or the safety device, in particular the service brake and safety gear;
  - whereby the information and operating parameters above are advantageously provided by the sensors of the safety nodes;
- condition of the shaft doors;
  - whereby this information is preferably provided by the safety node 10' of functional unit 8 of the shaft system;
- information on a possible collision with other elevator carriages 2;
  - whereby safety node 10 is advantageously provided with operating parameters from elevator carriages 2 adjacent to safety node 10 to generate this information, preferably stop points (as explained above and in the following with reference to FIG. 4 and FIG. 5); and
- condition of the transfer unit 9;
  - whereby this information is preferably provided by the safety node 10 assigned to the transfer unit 9.

The interaction of safety nodes, in particular of safety nodes within a defined monitoring room (as explained above), will be explained in more detail below on the basis of two examples. For a better understanding, reference will be made to the elements shown in FIG. 1 and FIG. 2.

First example—emergency stop of the elevator carriage if the risk of a collision is detected:

Each safety node 10 that is assigned an elevator carriage 2 as a functional unit, generates information with respect to a possible collision on the basis of its own sensors 12, 13, 14 and distributes this information via the interface 11 to all other safety nodes that have been assigned an elevator carriage as a functional unit.

Each safety node 10 that is assigned an elevator carriage 2 as a functional unit checks the risk of a collision on the basis of the information received from other safety nodes that have been assigned an elevator carriage 2 as a functional unit. If a possible collision is detected, a safe mode of the elevator carriage 2 is initiated—advantageously triggered by the control unit of the corresponding safety node 10.

As long as no safe mode should or has to be achieved, the safety node 10 that has been assigned an elevator carriage 2 as a functional unit grants all safety nodes that have been assigned a functional unit 4 of the drive system permission to activate the corresponding functional units 4 of the drive system. The functional units 4 of the drive system can, for example, be activated by energizing the corresponding linear motor segments if a linear drive is used as a drive system.

If the elevator carriage 2 is to be brought into a safe operating mode, the safety node 10 assigned to this elevator carriage 2 advantageously informs all safety nodes that are assigned functional units 4 of the drive system that the functional units 4 of the drive system responsible for this elevator carriage 2 are to be deactivated, for example by switching off the corresponding linear motor segments if a linear drive is used as a drive system.

All safety nodes that are assigned functional units 4 of the drive system check the responsibility for the elevator carriage 2 on the basis of the information transmitted via the interface 11 from the safety node 10 assigned to this elevator carriage 2. Depending on the result of this check, they deactivate or activate the corresponding functional units 4 of the drive system.

Second example—an elevator carriage enters a transfer unit:

Each safety node 10 that is assigned an transfer unit 9 as a functional unit of the shaft system, generates information with respect to a current condition of the transfer unit 9 on the basis of its own sensors 19, 20, 21 and sends this to all other safety nodes 10 that have been assigned an elevator carriage as a functional unit.

Each safety node 10 that is assigned an elevator carriage 2 as a functional unit checks the risk of a collision with a transfer unit 9 on the basis of the information received from the safety node 10 that has been assigned the corresponding transfer unit 9. If a possible collision is detected, the elevator carriage 2 is brought into a safe operating mode.

As long as this does not have to be brought into a safe operating mode, the safety node 10 assigned to the elevator carriage 2 grants all safety nodes assigned to a functional unit 4 of the drive system permission to activate the corresponding functional units 4 of the drive system, for example, permission to energize the corresponding linear motor segments if a linear drive is used as a drive system If the elevator carriage 2 is to be brought into a safe mode, the safety node 10 assigned to the elevator carriage 2 informs all safety nodes that are assigned a functional unit 4 of the drive system that the functional units 4 of the drive system responsible for this elevator carriage 2 are to be deactivated. If a linear drive is used as a drive system, for example, the information is sent to switch off the linear motor segments.

All safety nodes that are assigned a functional unit 4 of the drive system check their responsibility for this elevator carriage 2 on the basis of this information and deactivate the corresponding functional unit 4 of the drive system, for example the linear motor segment, or allow this to activate the corresponding functional unit 4 of the drive system, for example the linear motor segment. If a change to the operating mode of a transfer unit 9 poses a risk for the elevator carriage 2 or the persons being transported with this elevator carriage, the safety node 10" assigned to this transfer unit 9 does not allow a change in the condition of the transfer unit 9. A safety device 17, 17' is preferably activated that prevents a change in the condition of the transfer unit 9. One such safety device 17' is in particular a locking mechanism.

Figure 3:
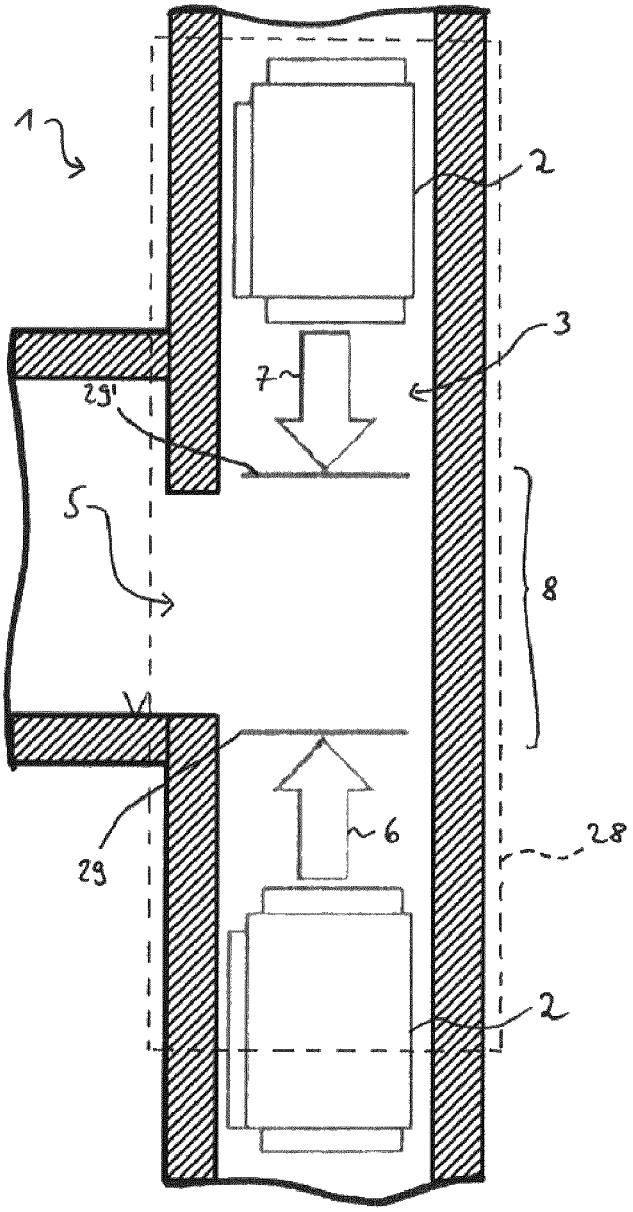
FIG. 3 a detail of an embodiment for an elevator system according to the invention in a simplified diagrammatic layout.

In the elevator system 1 shown partially in FIG. 3, one part of the shaft system 3 in which elevator carriages 2 can be moved separately, in other words essentially independent of each other, is shown together with two elevator carriages 2. The shaft system 3 hereby has a section 8 of the shaft system 3 that displays a shaft door 5 as a functional unit. This section of the shaft 8 is hereby assigned a safety node (not shown explicitly in FIG. 3). This safety node comprises a sensor (not shown explicitly in FIG. 3) that is designed to record an operating mode that deviates from a normal operating mode for this functional unit 8, whereby the elevator system 1 is designed to deactivate this functional unit 8 if such an operating mode that deviates from a normal operating mode is recorded, and to advantageously only move the elevator carriages 2 of the elevator system 1 outside this section 8 of the shaft system 3 that has at least one shaft door 5.

In the embodiment shown in FIG. 3, a sensor monitors in particular the correct opening and closing of the shaft doors with respect to the section of the shaft 8. If, as is shown by way of example in FIG. 3, the sensor records an unsuccessful closing of the shaft door 5 at the safety nodes or at the control unit of the safety node of the section of the shaft 8 as an operating parameter, the control unit advantageously deactivates this section of the shaft 8. The consequence of this is that the elevator carriages 2 can no longer enter this section of the shaft 8. This information is hereby transmitted to the signal nodes (not shown explicitly in FIG. 3) of the elevator carriages 2 at the latest when the elevator carriages 2 enter the defined monitoring room 28. The elevator system 1 and/or the safety system of the elevator system 1 is namely advantageously designed in such a way that all safety nodes in a defined monitoring room exchange information with each other. Advantageously, corresponding monitoring rooms are defined for the entire shaft system 3.

By deactivating the section of the shaft 8, the elevator carriage 2 moving in the upwards direction of travel 6 can at most move up to the lower limit of section 8 that is shown by the line 29. The elevator carriage 2 moving in the downwards direction of travel 7 can at most move up to the upper limit of section 8 that is shown by the line 29'. Otherwise, the elevator system 1 is advantageously still ready for operation.

Figure 4:
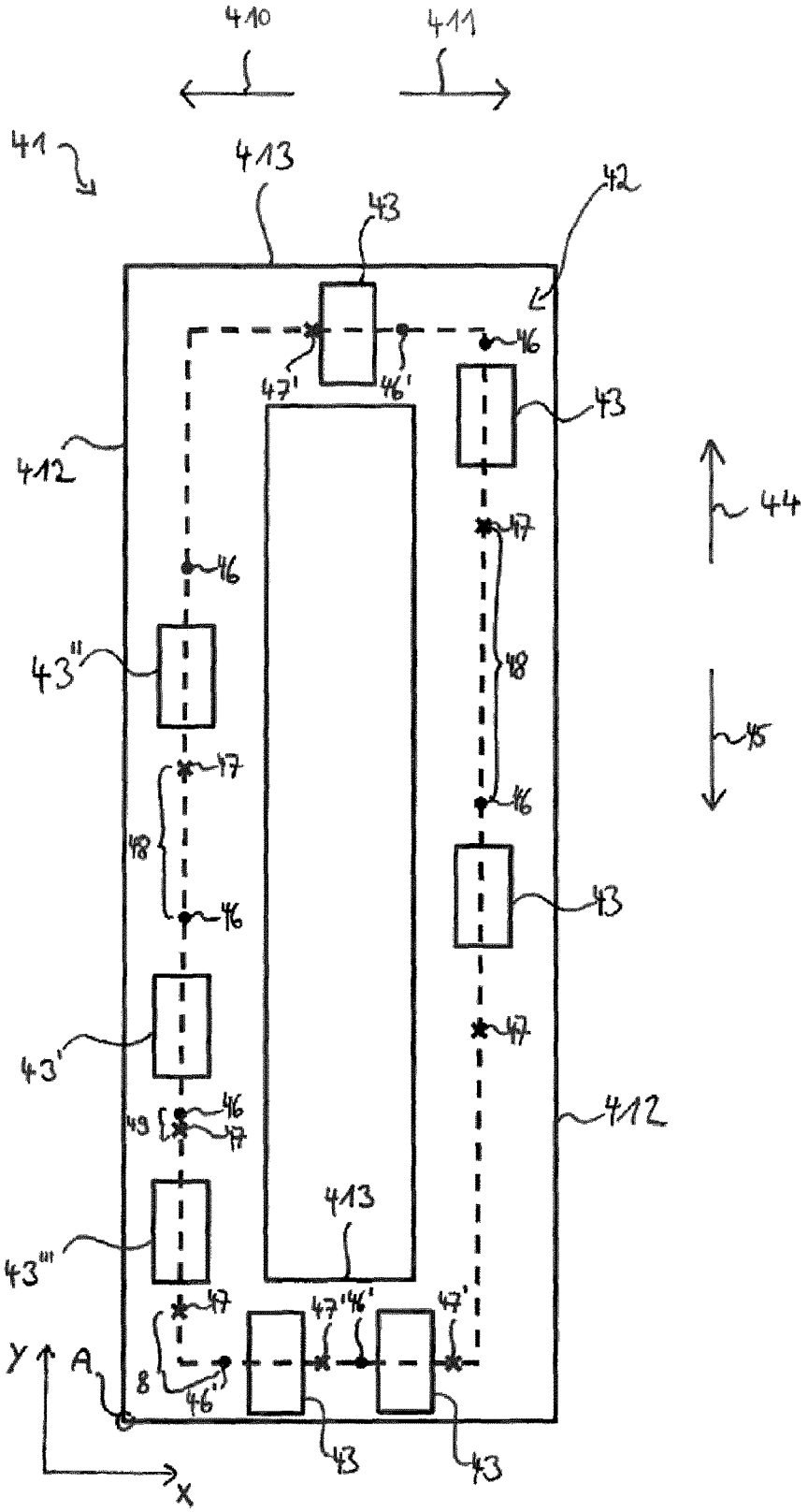
FIG. 4 an further embodiment for an elevator system according to the invention in a simplified diagrammatic layout.

The elevator system 41 shown in FIG. 4, which is not shown to scale for reasons of a better overview, comprises a shaft system 42 with two vertical shafts 412 and two connecting shaft 413. Furthermore, the elevator system 41 comprises a plurality of elevator carriages 43 (for example eight elevator carriages in FIG. 4) which can be moved separately in the shaft system 42 in successive operation, in other words, a plurality of elevator carriages 43 can be moved in a shaft 412 or in a shaft 413.

The elevator carriages 43 can hereby be moved upwards in a first direction of travel 44 in the shafts 412 (shown symbolically in FIG. 4 by the arrow 44) and downwards in a second direction of travel 45 (shown symbolically FIG. 4 by the arrow 45). In the connecting shafts 413, via which the elevator carriages 43 can change between the shafts 412, the elevator carriages can also be moved laterally in a third direction of travel 410 (shown symbolically in FIG. 4 by the arrow 410) and in a fourth direction of travel 411 (shown symbolically in FIG. 4 by the arrow 411).

It is in particular envisaged, that the elevator system comprises at least a linear motor as a drive system (not shown explicitly in FIG. 4), by means of which the elevator carriages 43 can be moved within the shaft system 42.

The elevator system 41 shown in FIG. 4 is hereby operated in such a way that a first stop point 46 is continually calculated for every elevator carriage 43 for the first possible direction of travel and a second stop point 47 for the second possible direction of travel. Thus, a stop point is calculated for every elevator carriage 43 for at least one direction of travel. Thus, an upper shaft door is calculated as a first stop point 46 for the elevator carriages 43 in the vertical shafts 412, and a lower stop point is calculated as a second stop point 47. In the connecting shafts 413, a stop point in the direction of travel of the corresponding elevator carriage 43 is calculated as stop point 46' and a second stop point opposite to the direction of travel of the corresponding elevator carriages 42 is calculated as stop point 47'.

The stop points can be defined in particular by coordinates (x, y), whereby lateral stop points are defined by the x-coordinates and vertical stop points by the y-coordinates. For example, point A in FIG. 4 can be assigned the coordinates (0, 0).

The two stop points 46, 47 and 46', 47' each specify, starting from the current position of the corresponding elevator carriage 43, the latest point at which the elevator carriage 43 can stop, assuming a worst case scenario, for each of the possible directions of travel 44, 45 and 410, 411. In particular, an upper stop point 46 is calculated, i.e. predetermined, for an elevator carriage 43' traveling upwards, taking into account current operating parameters such as the direction of travel, speed and load capacity of the elevator carriage 43', where the elevator carriage 43' would stop if the elevator carriage 43' were to be accelerated to its maximum in the direction of travel and then braked. The lower stop point 47 of the elevator carriage 43' is calculated for the worst case assumption, namely that the drive fails, the elevator carriage 43' consequently falls and the elevator carriage 43' is only then braked.

Corresponding predictions are carried out continually for the further elevator carriages 43 of the elevator system. The elevator carriages 43 advantageously hereby display a control unit, for example a micro controller circuit designed as a control unit (not shown explicitly in FIG. 4).

The distance from the first stop point 6 of an elevator carriage to the second stop point 47 of a second elevator carriage is determined for every elevator carriage 43 that has an adjacent elevator carriage in an initial direction of travel. Moreover, the distance from the second stop point 47 of an elevator carriage to the first stop point 46 of the second elevator carriage is determined for every elevator carriage 43 that has a second, adjacent elevator carriage in the second direction of travel.

For example, the distance 48 from the upper stop point 46 of the elevator carriage 43' to the lower stop point 47 of the elevator carriage 43' is determined for the elevator carriage 43' that has a second, adjacent elevator carriage 43" in the second direction of travel 44. To this end, the lower stop point 47 of the elevator carriage 43" is advantageously transmitted to a control unit (not shown explicitly in FIG. 4) of the elevator carriage 43'. The distance 48 determined in this example is positive. There is thus no risk of a collision with respect to the elevator carriages 43' and 43".

In addition, the elevator carriage 43' has an adjacent elevator carriage 43'" in the further direction of travel 45. Thus, the distance 49 from the lower stop point 47 of the elevator carriage 43' to the upper stop point 46 of the elevator carriage 43' is determined for the elevator carriage 43'. To this end, the upper stop point 46 of the elevator carriage 43" is advantageously transmitted to a control unit (not shown explicitly in FIG. 4) of the elevator carriage 43'. The distance 49 determined in this example is negative, in other words the upper stop point 46 of the elevator carriage 43'" lies below the lower stop point 47 of the elevator carriage 43'. There is thus the risk of a collision with respect to the elevator carriages 43' and 43". On account of the negative distance 49 between the lower stop point 46 of the elevator carriage 43' and the upper stop point 47 of the elevator carriage 43'", the elevator system is brought into a safe mode, in particular by activating brakes on these elevator carriages, preferably triggered by the control units assigned to the corresponding elevator carriages 43' and 43'".

Since only one stop point is transmitted to an elevator carriage 43 from the two adjacent elevator carriages, the communication load for the procedure employed is advantageously low.

Figure 5:
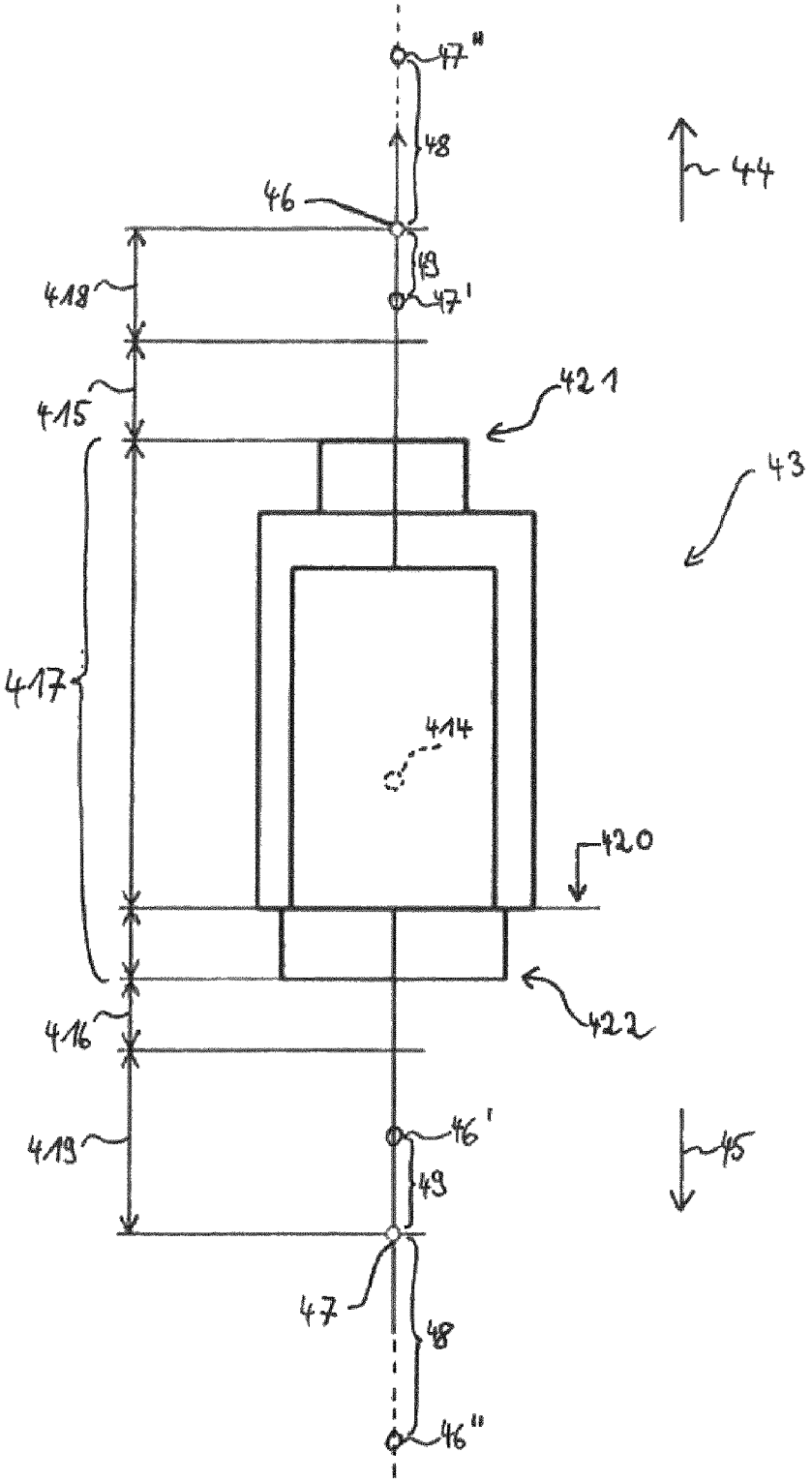
FIG. 5 an embodiment for an elevator carriage for use in an elevator system shown in FIG. 4, with stop points shown by way of example, in a simplified diagrammatic layout.

Reference is made to FIG. 5 for a further explanation of the stop points that are calculated for an elevator carriage 43 in accordance with a procedure according to the invention. FIG. 5 hereby shows an elevator carriage 43 with an overall elevator carriage height of 417 and an entrance threshold 420.

An example of a calculated stop point 46, 47 is shown for each direction of travel 44, 45 for the elevator carriages 43 that can be moved in the direction of travel 44 and in the direction of travel 45 (the direction of travel in FIG. 5 is shown symbolically in each case by arrows 44, 45). The upper stop point 46 is hereby shown for the direction of travel 44 and the lower stop point 47 for the direction of travel 45.

The upper stop point 46 hereby indicates the latest point where the elevator carriage 43 can stop with the upper end of the elevator carriage 421 starting from the current operating parameters and assuming a worst-case scenario in the direction of travel 44. The distance between the stop point 46 and the upper end of the elevator carriage 421 in the embodiment shown here results from the sum total of an optionally defined minimum distance 415 to the elevator carriage 43 that may not be fallen below, and a braking distance 418 calculated from the current traveling parameters assuming a worst-case scenario. The stop points are calculated, for example, by means of a correspondingly configured predictor model.

The lower stop point 47 hereby indicates the latest point where the elevator carriage 43 can stop with the lower end of the elevator carriage 422 starting from the current operating parameters and assuming a worst-case scenario in the direction of travel 45. The distance between the stop point 47 and the lower end of the elevator carriage 422 in the embodiment shown here results from the sum total of an optionally definable minimum distance 416 to the lower end of the elevator carriage 422 that may not be fallen below, and a braking distance 419 calculated from the current traveling parameters assuming a worst-case scenario.

The positions of the stop points vary depending on the respective current traveling parameters. If the elevator carriage is at a standstill, the stop points will move closer to the elevator carriage. If the elevator carriage is moving at high speed upwards, in other words in the direction of travel 44, the upper stop point will lie further up. The case may in particular arise that even at a high speed, the lower stop point 47 is determined at position 414, because a movement in the direction of travel 45 can hereby be ruled out, even in the worst-case scenario.

This kind of upper stop point and a lower stop point is calculated for every such elevator carriage 43 shown in FIG. 5. In each case, the distance between the upper stop point 46 of an elevator carriage and the lower stop point 47' or 47" of an adjacent elevator carriage above this elevator carriage and the distance between the lower stop point 47 of this elevator carriage and the upper stop point 46' or 46" of an adjacent elevator carriage below this elevator carriage is hereby determined. With a non-critical operation, the distances 48 are positive because 47" is greater than 46 and 47 greater than 46". With a negative distance, on the other hand, there is the risk of a collision. This kind of negative distance arises if 46 is greater than 47' or 46' is greater than 47. If this kind of negative distance is determined, the elevator system is brought into a safe operating mode, in particular into as safe mode.

The embodiments shown in the figures and explained in connection with these serve to describe the invention and are not restrictive for these. The embodiments that are explained are not reproduced true to scale in the Figures for reasons of a better overview.

REFERENCE NUMBERS

1 Elevator system
2 Elevator carriage
3 Shaft system
4 Drive system
5 Shaft door
6 Initial direction of travel (symbolized by single arrow)
7 Second direction of travel (symbolized by double arrow)
8 Section of a shaft comprising at least one shaft door as a functional unit of the shaft system
9 Transfer unit as a functional unit of the shaft system
10 Safety node
10' Safety node
10" Safety node
11 Interface
12 Sensor
13 Sensor
14 Sensor
15 Sensor to record the condition of the shaft door
16 Safety device
16' Safety device
17 Safety device
17' Safety device
18 Safety device
18' Safety device
19 Sensor

20 Sensor
21 Sensor
26 Data transmission between the safety nodes
27 Internal data transmission in a safety node
28 Monitoring room
29 Lower limit of a section of the shaft (8) (shown symbolically by a line)
29 Upper limit of a section of the shaft (8) (shown symbolically by a line)
41 Elevator system
42 Shaft system
43 Elevator carriage
43' Elevator carriage
43" Elevator carriage
43''' Elevator carriage
44 Initial direction of travel
45 Second direction of travel
46 First stop point
46' First stop point
46" First stop point
47 Second stop point
47' First stop point
47" First stop point
48 Positive distance between calculated stop points
49 Negative distance between calculated stop points
410 Third direction of travel
411 Fourth direction of travel
412 Vertical shaft
413 Connecting shaft
414 Extreme position for a possible stop point
415 Minimum distance to be observed by the carriage
416 Minimum distance to be observed by the carriage
417 Elevator carriage height
418 Calculated braking distance
419 Calculated braking distance
420 Entrance threshold
421 Upper end of elevator carriage
422 Lower end of elevator carriage

The invention claimed is:

1. An elevator system comprising:
a plurality of elevator carriages;
a shaft system enabling a loop operation of the elevator carriages;
at least one drive unit; and
a safety system with a plurality of safety nodes, wherein the safety system brings the elevator system into a safe operating mode whenever an operating mode of the elevator system deviates from a normal operating mode,
wherein the elevator carriages, the shaft system and at least one drive unit each form at least one functional unit, and
wherein at least one drive unit can be operated sectionwise in the shaft, in such a way that the elevator carriages can be moved independently of each other in defined sections of the shaft system, wherein each of the defined sections is a functional unit (4) of the drive unit;
wherein at least one of the safety nodes is assigned to each of the functional units, wherein the safety nodes are each connected to at least one of the other safety nodes through at least one interface for transferring data,
the safety nodes in each case including at least one sensor to record an operating parameter of the correspondingly assigned functional unit, and the safety nodes each include at least one control unit,
which is designed to analyze the operating parameter recorded by at least one sensor of the corresponding safety node and,
taking into consideration the transmitted data from at least another safety node, to make an assessment of a possible deviation from the normal operating mode.

2. The elevator system according to claim 1, wherein the shaft system has at least two vertically extended transportation routes, along which the elevator carriages can be moved vertically, as well as at least two transfer units for displacing the elevator carriages, wherein each of the transfer units is a functional unit of the shaft system, which in each case is assigned to at least one of the safety nodes.

3. The elevator system according to claim 2, wherein the transportation routes are rails, along which the elevator carriages using at least one linear drive as the drive unit are movable, and each rail with at least one rotatable segment for a vertical transportation is designed as a transfer unit, wherein these rotatable segments can be arranged relative to one another, such that an elevator carriage of the elevator system can be moved along the segments between the rails.

4. The elevator system of claim 1 wherein the functional units each contain at least one safety device, which, by triggering, can bring the corresponding functional unit into a safe operating mode and can be directly controled by the control unit of the safety node assigned to the corresponding functional unit.

5. The elevator system according to claim 1, wherein a plurality of monitoring rooms is defined for the shaft system, wherein each monitoring room is assigned a plurality of functional units, wherein the safety nodes of the functional units in a monitoring room are connected to at least one interface for transferring data.

6. The elevator system of claim 1 wherein the elevator system is designed to be partially deactivatable, in such a way, that individual units or groups of functional units can be deactivated, wherein the elevator system is further adapted to continue to be operational with non-deactivated functional units.

7. The elevator system of claim 1 wherein each section of the shaft system including at least one a shaft door is a functional unit, to which a safety node is assigned.

8. The elevator system according to claim 7, wherein the safety node, to which the section of the shaft system as a functional unit and including at least one shaft door, contains at least one sensor, which is designed to record a deviation from the normal operating mode of this functional unit, wherein the safety system of the elevator system is designed to deactivate this functional unit if such an operation condition that deviates from the normal operation conditions is recorded, and the elevator carriages of the elevator system are only moved outside of the section of the shaft system having at least one shaft door.

9. The elevator system of claim 1 wherein the control unit of a safety node, assigned to an elevator carriage as a functional unit, is designed to continually calculate a first stop point for the first direction of travel of the elevator carriage and to continually calculate a second stop point for the other direction of travel, wherein the corresponding stop point indicates the position at which the elevator carriage can stop, if necessary, in each direction of travel.

10. The elevator system of claim 9 wherein the safety node, assigned to the elevator carriage as a functional unit, is thus designed, such that the calculated initial stop points are always at least transmitted via an interface to the safety node, which is assigned to the adjacent elevator carriage in the first direction of travel, and the calculated second stop points are always at least transmitted via an interface to the corresponding safety node, which is assigned to the adjacent elevator carriage in the second direction of travel.

11. The elevator system according to claim 10, wherein the control unit of a safety node, assigned to the elevator carriage as a functional unit, is designed such that the distance between the first stop point of this elevator carriage and the second stop point of the adjacent elevator carriage in the first direction of travel is determined and the distance between the second stop point of this elevator carriage and the first stop point of the adjacent elevator carriage traveling in the second direction is determined, wherein, if a negative distance is calculated, the safety system of the elevator system brings the system into a safe operating mode.

* * * * *